United States Patent [19]

Rowles et al.

[11] Patent Number: 4,749,393

[45] Date of Patent: Jun. 7, 1988

[54] PROCESS FOR THE RECOVERY OF HYDROGEN/HEAVY HYDROCARBONS FROM HYDROGEN-LEAN FEED GASES

[75] Inventors: Howard C. Rowles, Center Valley; Jeffrey A. Hopkins, Whitehall, both of Pa.

[73] Assignee: Air Products and Chemicals, Inc., Allentown, Pa.

[21] Appl. No.: 99,354

[22] Filed: Sep. 18, 1987

[51] Int. Cl.[4] ..... F25J 3/02

[52] U.S. Cl. ..... 62/24; 62/36; 62/42; 62/44

[58] Field of Search ..... 62/18, 23, 24, 32, 36, 62/42, 44

[56] References Cited

U.S. PATENT DOCUMENTS

| | | | |
|---|---|---|---|
| 3,430,418 | 3/1969 | Wagner | 55/25 |
| 3,838,553 | 10/1974 | Doherty | 55/58 |
| 4,180,552 | 12/1979 | Graham et al. | 423/359 |
| 4,238,211 | 12/1980 | Stuart | 62/24 |
| 4,548,618 | 10/1985 | Linde et al. | 55/16 |
| 4,579,566 | 4/1986 | Brugerolle | 62/42 |
| 4,617,036 | 10/1986 | Suchdeo et al. | 62/42 |
| 4,654,047 | 3/1987 | Hopkins et al. | 62/23 |
| 4,654,063 | 3/1987 | Auvil et al. | 62/18 |

OTHER PUBLICATIONS

W. K. Lam et al., "Recover Valuable Off Gasses by Braun Roe Process", Aiche Nat'l Meeting, Apr. 6-10, 1986.

*Primary Examiner*—Ronald C. Capossela

*Attorney, Agent, or Firm*—Willard Jones, II; James C. Simmons; William F. Marsh

[57] ABSTRACT

The process of this invention is a hybrid gas separation process which recovers both heavy hydrocarbon and high purity hydrogen products from a gas stream containing a relatively low concentration of hydrogen. The heavy hydrocarbon product may consist of $C_2+$, $C_3+$ and/or $C_4+$ hydrocarbons. The light hydrocarbons and other light components, such as $N_2$ and CO, are removed as a light fuel gas stream. After convertional removal of any components which might freeze at low temperatures, the feed gas is combined with recycle gas from the hydrogen purifier and fed to the cryogenic unit.

11 Claims, 2 Drawing Sheets

PROCESS FOR THE RECOVERY OF HYDROGEN/HEAVY HYDROCARBONS FROM HYDROGEN-LEAN FEED GASES

TECHNICAL FIELD

The present invention relates to a process for the recovery of hydrogen and heavy hydrocarbons from hydrogen-lean feed gas streams.

BACKGROUND OF THE INVENTION

Several processes are known in the art for the separation and recovery of hydrogen from hydrogen-hydrocarbon feed gas streams. Among these are the following:

Cryogenic Partial Condensation Processes—These processes can recover hydrogen as a high purity product, but without co-product heavy hydrocarbons. The capital expense is not justified for feed gases containing only small amounts of hydrogen. Recovery of heavy hydrocarbon co-products is possible, but purity will be low due to the high quantities of light hydrocarbons and other light components which will be condensed with the desired heavy hydrocarbons. The cost and energy consumption of downstream separation and purification (fractionation) facilities for the heavy hydrocarbon products will also be high. Several such processes are described in a paper by W. K. Lam, et al., titled "Recover Valuable OffGases by the Braun ROE Process." presented at the AIChE National Meeting, 6–10 April 1986 in New Orleans, LA.

Membrane Separation Processes—These processes can recover hydrogen but cannot separate light hydrocarbons from desirable heavy hydrocarbons. Hydrogen recovery is very low when the concentration of $H_2$ in the feed gas is low. One such process is described in U.S. Pat. No. 4,180,552.

U.S. Pat. Nos. 4,548,618; 4,654,047 and 4,654,063 described combination membrane and cryogenic processes to recover hydrogen, however, these patents do not address the recovery of heavy hydrocarbons. These processes are most suitable for feed gases containing relatively large amounts of hydrogen, i.e. more than 50 mole% hydrogen.

Pressure Swing Adsorption (PSA) Processes—These processes have the same disadvantage as the membrane process; i.e., low hydrogen recovery for hydrogen-lean feed gases and inability to separate light and heavy hydrocarbons. One such process is described in U.S. Pat. No. 3,430,418.

U.S. Pat. No. 3,838,553 describes a combination PSA and cryogenic process to recover high purity hydrogen at high recovery, but again does not address the recovery of heavy hydrocarbons and is most suitable for hydrogen-rich feed gases.

Cryogenic Dephlegmation/Partial Condensation Processes—These processes, using dephlegmation for heavy hydrocarbon recovery followed by partial condensation for hydrogen recovery, can recover heavy hydrocarbon and high purity hydrogen hydrogen products. However, the power required to recompress the hydrogen and light gas reject streams which must be reduced to very low pressures to provide the necessary refrigeration for high hydrogen purity and recovery is very high. The capital cost of cryogenic equipment to separate non-hydrocarbon light impurities, such as $N_2$ and CO, from hydrogen is also very high.

SUMMARY OF THE INVENTION

The present invention relates to an improvement to a process for the separation and recovery of heavy hydrocarbon and high purity hydrogen products from a feed gas stream containing heavier hydrocarbons and a relatively small concentration of hydrogen. Wherein the process, the feed gas stream is cleaned of acid gases and dehydrated; the cleaned, dehydrated gas stream is separated in a cryogenic separation system producing a light fuel gas stream, at least one heavy hydrocarbon product stream, and a hydrogen-enriched gas stream; and the hydrogen-enriched gas stream is purified in a hydrogen purifier thereby producing a high purity hydrogen product and a purifier reject stream which is recycled and combined with the cleaned, dehydrated feed gas stream as a combined feed to the cryogenic separation system.

In the improvement to the process, the combined feed is cooled and partially condensed, then the cooled and partially condensed combined feed is separated to produce a liquid and a vapor phase. The vapor phase is cooled in a dephlegmator wherein the vapor phase is partially condensed producing a rectified, liquid condensate, which is recovered from the dephlegmator and warmed to recover refrigeration. The non-condensed vapor is then further cooled and partially condensed in indirect heat exchange thereby producing a hydrogen-enriched gas phase and a light fuel liquid phase. The hydrogen-enriched gas phase is then separated from the light fuel liquid phase.

The initially separated liquid phase, which has been warmed to recover refrigeration, and the warmed rectified, liquid condensate from the dephlegmator are removed as heavy hydrocarbon product(s). The light liquid fuel gas stream is flashed and vaporized to recover refrigeration thereby producing a light fuel gas stream. Finally, the hydrogen-enriched gas phase is warmed to recover refrigeration and fed to the hydrogen purifier.

The process of the present invention can further comprise work expanding and/or compressing the hydrogen-enriched gas prior to feeding to the hydrogen purifier; compressing the purified hydrogen product from the hydrogen purifier; compressing the recycle gas from the hydrogen purifier; compressing the heavy hydrocarbon product(s); and/or compressing the light fuel gas stream. The heavy hydrocarbon product(s) may be fed to a distillation column for further separation and/or purification.

The process of the present invention is equally applicable to all types of hydrogen purifiers, e.g. membrane separators and pressure swing adsorption units. The membrane separation unit may comprise one or more stages, with recompression of the permeate between stages.

DETAILED DESCRIPTION OF THE INVENTION

The process of this invention is a hybrid gas separation process which recovers both heavy hydrocarbon and high purity hydrogen products, i.e. at least 95 mole %, preferably 97 mole % hydrogen, from a gas stream containing a relatively low concentration of hydrogen, i.e. less than 40 mole % hydrogen, such as an FCC unit offgas or a delayed coker offgas. The heavy hydrocarbon product may consist of $C_2+$, $C_3+$ and/or $C_4+$ hydrocarbons. The light hydrocarbons and other light components, such as $N_2$ and CO, are removed as a light fuel gas stream. After conventional removal of any components which might freeze at low temperatures, the feed gas is combined with recycle gas from the hydrogen purifier and fed to the cryogenic system.

In the cryogenic system, the desired heavy hydrocarbon components are condensed and separated by a combination of partial condensation/dephelgmation, or by dephlegmation alone, followed by partial condensation to upgrade the hydrogen to a purity more suitable for feed to the hydrogen purifier, for example, 70 to 90 mole %. Refrigeration for the cryogenic system is typically provided by Joule-Thomson expansion of one or more of the product streams, particularly the light fuel gas stream, to suitable low pressure(s). Work expansion of one of the process streams, e.g. the enriched hydrogen stream, or external refrigeration, or any combination may also be utilized. External refrigeration may, for example, be supplied by a staged, multi-component closed circuit refrigeration cycle. Such a cycle is particularly suitable for recovery of heavy hydrocarbons in a predominantly liquid state, such as for a feed to a distillation column.

A dephlegmator is preferred to recover at least a portion of the heavy hydrocarbon product(s). The rectification provided by the dephlegmator provides high recovery of desirable heavy hydrocarbon products, while minimizing the quantity of lighter components which are co-condensed. The dephlegmator therefore provides a much higher purity heavy hydrocarbon product than can be obtained by conventional partial condensation processes, with the same or higher recovery.

The upgraded hydrogen produced in the cryogenic system is fed to the hydrogen purifier, which may be of any suitable type, such as a membrane, PSA or similar non-cryogenic system. The hydrogen purifier generates the required high purity hydrogen product, and a reject gas stream which is recycled back to the cryogenic system to maximize hydrogen recovery.

Figure 1:
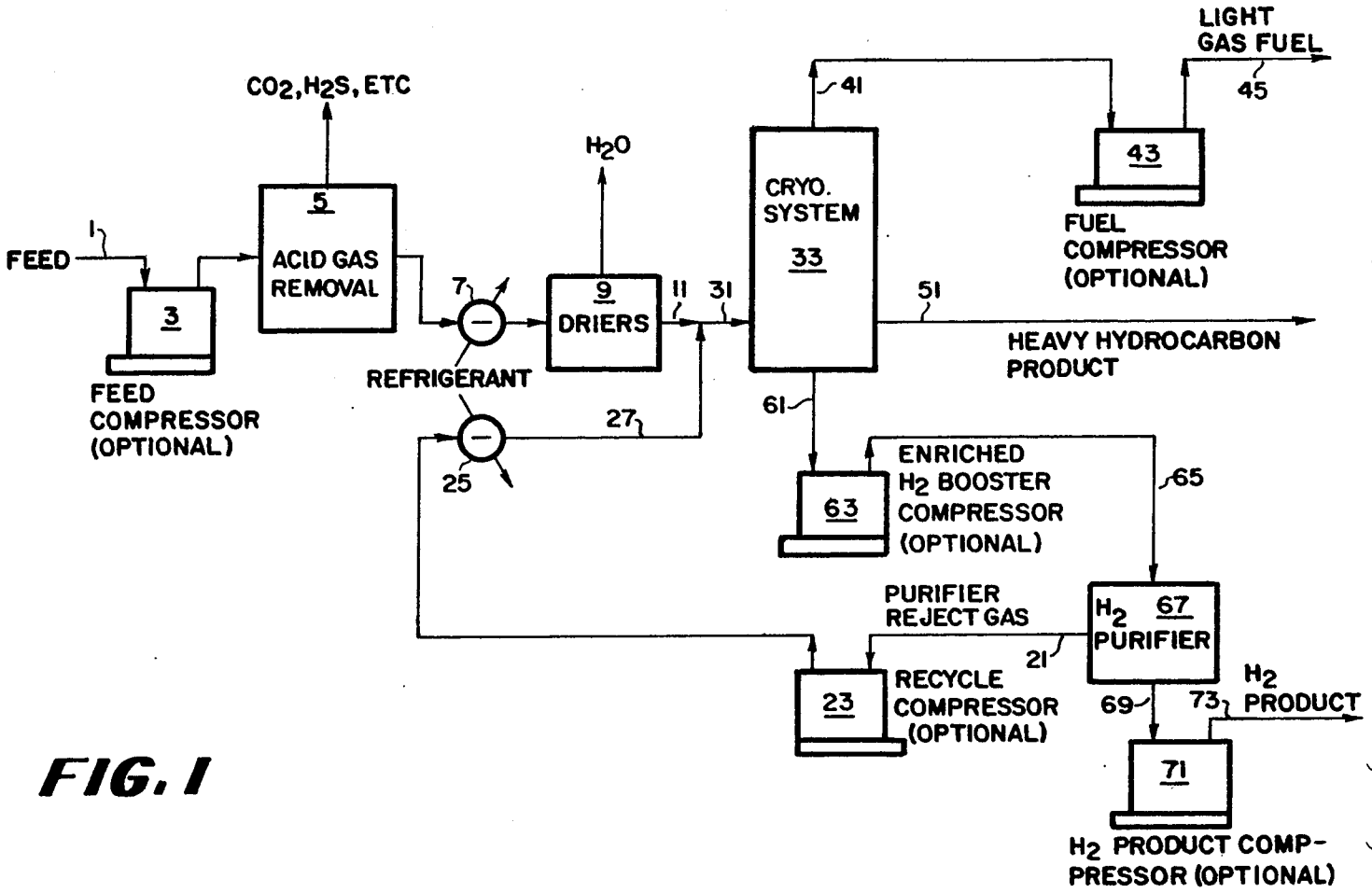
FIG. 1 is a generalized flow diagram of the process of the present invention.

The basic flow diagram is as shown in FIG. 1. The details of one embodiment of the cryogenic system are shown in FIG. 2.

With reference to FIG. 1, a lean hydrogen-containing feed stream is introduced to the process via line 1. This feed stream is, optionally, compressed in feed compressor 3, cleaned of acid gases, e.g. $CO_2$ and $H_2S$, in amine or similar unit 5, cooled, if necessary, in heat exchanger 7 and dried to remove water in drier 9. This compressed, cleaned and dried feed stream, now in line 11, is combined with recycled purifier reject gas, in line 27, and fed to cryogenic system 33 via line 31. The combined feed to cryogenic system 33 is separated into light fuel gas stream 41, one or more heavy hydrocarbon products, stream 51 and hydrogen purifier feed 61. The light fuel gas stream, in line 41, may be further compressed in fuel compressor 43 and removed from the process as a light fuel gas product, via line 45. The hydrogen purifier feed stream in line 61 is compressed, if necessary, in booster compressor 63 and fed via line 65 to hydrogen purifier 67. In hydrogen purifier 67 the feed from line 65 is separated into a purified hydrogen stream, in line 69, and a purifier reject stream, in line 21. The purified hydrogen stream, in line 69, may be compressed in hydrogen product compressor 71 and then removed from the process as hydrogen product via line 73. The purifier reject gas stream is compressed, if necessary, in recycle compressor 23 and optionally cooled in heat exchanger 25 prior to being combined via line 27 with the compressed, cleaned and dried feed stream via line 11 to form stream 31.

Figure 2:
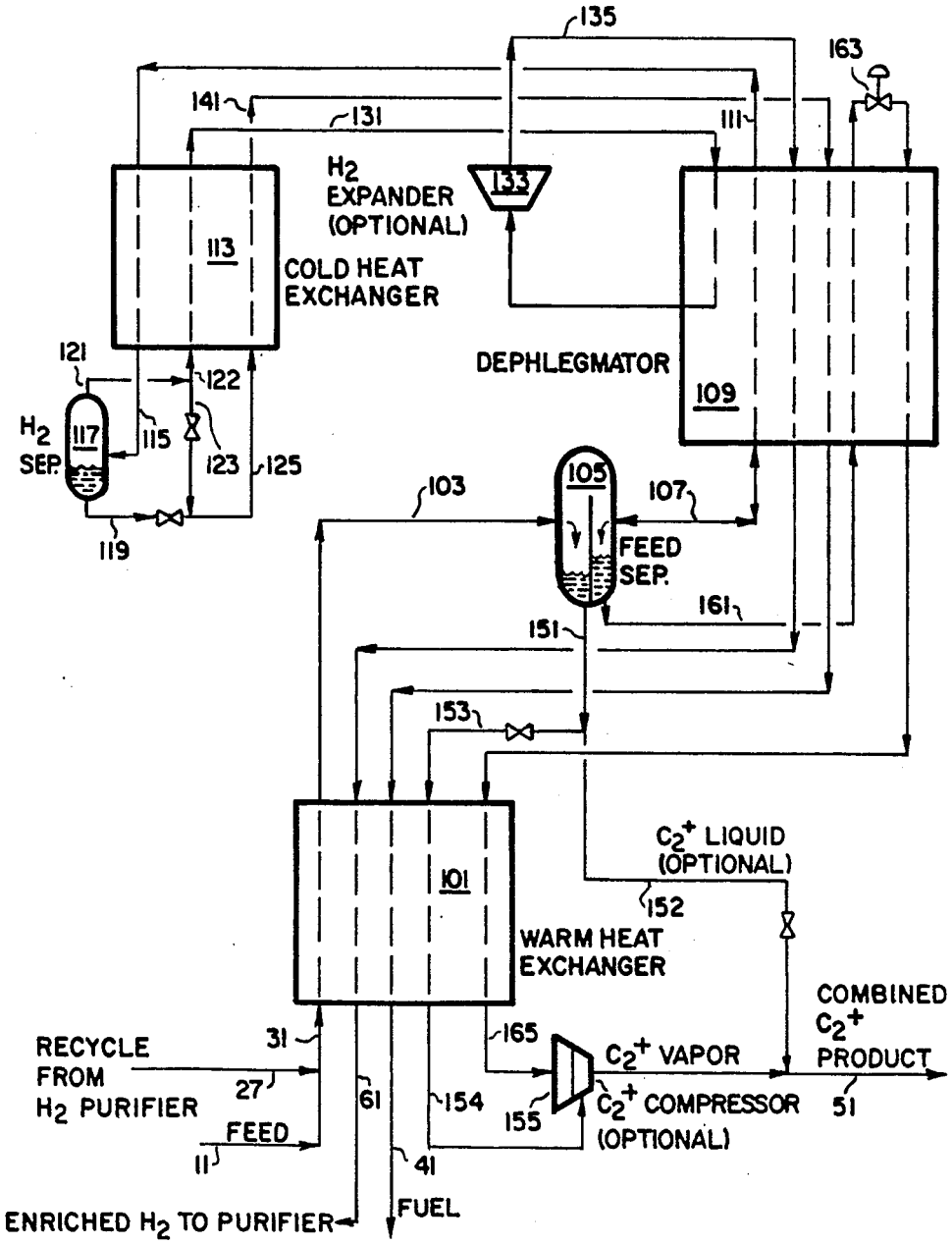
FIG. 2 is a detailed flow diagram of one embodiment of the cryogenic system of the process of the present invention.

With reference to FIG. 2, which details one embodiment of cryogenic system 33 suitable for the recovery of $C_2+$ hydrocarbons, the combined feed, in line 31, is cooled and partially condensed in warm heat exchanger 101 and fed to separator 105, via line 103. The vapor from separator 105 is fed via line 107 to dephlegmator 109 wherein it is partially condensed, rectified and separated into a bottom liquid portion and an overhead gaseous portion. The rectified bottom liquid portion is returned to separator 105, via line 107. The overhead gaseous portion in line 111 is further cooled and partially condensed in cold heat exchanger 113 and then fed via line 115 to hydrogen separator 117 for removal of the condensed portion. The liquid phase from hydrogen separator 117 is removed via line 119. The hydrogen-enriched gas phase from hydrogen separator 117 is removed via line 121 and optionally split into substreams 122 and 123.

Major substream 122 is warmed in cold heat exchanger 113 and becomes stream 131. The warmed substream, now line 131, is warmed further in dephlegmator 109, optionally expanded in expander 133 and further warmed in dephlegmator 109 and warm heat exchanger 101 to recover refrigeration prior to being removed from cryogenic system 33 via line 61.

Optional minor substream 123 is reduced in pressure and combined with liquid stream 119 to lower the temperature of combined stream 125. Combined stream 125 is vaporized and warmed in cold heat exchanger 113, dephlegmator 109 and warm heat exchanger 101 to recover refrigeration, prior to removal from cryogenic system 33 via line 41.

Separator 105 is, preferably, a segregated separator, allowing for the segregation of the relatively heavy liquid separated from stream 103 and the lighter liquid produced in dephlegmator 109, returning to separator 105 via line 107. The liquid condensed out in warm heat exchanger 101 (stream 103) is removed from separator 105 via lines 151 and 153, and warmed in warm heat exchanger 101. The rectified liquid recovered from dephlegmator 109 (via line 107) is removed from separator 105 via line 161. Stream 161 is subcooled in dephlegmator 109, flashed in valve 163 and then warmed in dephlegmator 109 and warm heat exchanger 101 to recover refrigeration. These two vaporized liquid streams in line 154 and 165 can then be optionally compressed in $C_2+$ compressor 155 prior to being removed at $C_2+$ product, via line 51.

Another option available in the above system would be to remove a portion of liquid stream 151 as a liquid product stream 152, which may also be combined with the vaporized $C_2+$ product streams in line 51.

As an example of the efficacy of the present invention, Table I lists flows, compositions, and operating conditions for selected streams for hydrogen and $C_2^{30}$ hydrocarbon recovery from a fluid catalytic cracker (FCC) offgas, using a membrane separation unit as the hydrogen purifier.

TABLE I

OPERATING CONDITIONS AND FLOW RATES FOR SELECTED STREAMS

| Stream No. | Phase | Temperature °F. | Pressure psia | Total Flow # mol/hr | Component Flows #mol/hr H2 | N2 | CO | Cl | C2= | C2 | C3= | C3 | C4+ |
|---|---|---|---|---|---|---|---|---|---|---|---|---|---|
| 11 | VAP | 57 | 315 | 2413.90 | 343.80 | 164.60 | 19.40 | 951.60 | 263.90 | 380.10 | 191.30 | 60.50 | 38.70 |
| 21 | VAP | 50 | 280 | 185.77 | 66.94 | 86.52 | 6.03 | 26.26 | 0.01 | | | | |
| 27 | VAP | 57 | 315 | 185.77 | 66.94 | 86.52 | 6.03 | 26.26 | 0.01 | | | | |
| 31 | VAP | 57 | 315 | 2599.67 | 410.74 | 251.12 | 25.43 | 977.86 | 263.91 | 380.10 | 191.30 | 60.50 | 38.70 |
| 41 | VAP | 49 | 52 | 1051.66 | 20.43 | 152.37 | 17.46 | 836.50 | 23.49 | 1.41 | | | |
| 61 | VAP | 49 | 295 | 515.06 | 386.29 | 92.97 | 6.83 | 28.95 | 0.01 | | | | |
| 69 | VAP | 50 | 100 | 329.20 | 319.32 | 6.36 | 0.80 | 2.72 | | | | | |
| 103 | V&L | −30 | 310 | 2599.67 | 410.74 | 251.12 | 25.43 | 977.86 | 263.91 | 380.10 | 191.30 | 60.50 | 38.70 |
| 107 | VAP | −30 | 310 | 2309.08 | 409.64 | 249.88 | 25.21 | 955.22 | 231.55 | 305.43 | 97.30 | 28.56 | 6.29 |
| 107 | LIQ | −69 | 310 | 742.36 | 2.92 | 4.54 | 0.92 | 89.77 | 208.05 | 304.02 | 97.30 | 28.56 | 6.29 |
| 111 | VAP | −175 | 310 | 1566.71 | 406.72 | 245.34 | 24.29 | 865.45 | 23.50 | 1.41 | | | |
| 115 | V&L | −261 | 305 | 1566.71 | 406.72 | 245.34 | 24.29 | 865.45 | 23.50 | 1.41 | | | |
| 119 | LIQ | −261 | 305 | 1048.65 | 18.17 | 151.83 | 17.42 | 836.33 | 23.49 | 1.41 | | | |
| 121 | VAP | −261 | 305 | 518.07 | 388.55 | 93.51 | 6.87 | 29.12 | 0.01 | | | | |
| 122 | VAP | −261 | 305 | 515.06 | 386.29 | 92.97 | 6.83 | 28.95 | 0.01 | | | | |
| 123 | VAP | −261 | 305 | 3.01 | 2.26 | 0.54 | 0.04 | 0.17 | | | | | |
| 125 | V&L | −266 | 59 | 1051.66 | 20.43 | 152.37 | 17.46 | 836.50 | 23.49 | 1.41 | | | |
| 131 | VAP | −199 | 303 | 515.06 | 386.29 | 92.97 | 6.83 | 28.95 | 0.01 | | | | |
| 141 | VAP | −199 | 57 | 1051.66 | 20.43 | 152.37 | 17.46 | 836.50 | 23.49 | 1.41 | | | |
| 151 | LIQ | −30 | 310 | 290.59 | 1.10 | 1.25 | 0.22 | 22.64 | 32.37 | 74.67 | 94.00 | 31.94 | 32.41 |
| 152 | LIQ | −30 | 310 | 42.00 | 0.16 | 0.18 | 0.03 | 3.27 | 4.68 | 10.79 | 13.59 | 4.62 | 4.68 |
| 154 | VAP | 49 | 57 | 248.59 | 0.94 | 1.07 | 0.19 | 19.36 | 27.69 | 63.88 | 80.41 | 27.32 | 27.72 |
| 165 | VAP | 49 | 15 | 742.36 | 2.92 | 4.54 | 0.92 | 89.77 | 208.05 | 304.02 | 97.30 | 28.56 | 6.29 |

Feed gas in line 1 is compressed, treated with monoethanolamine (MEA) to remove $CO_2$ and $H_2S$, precooled to condense most of the water, and then dried, stream 11. Recycle gas from membrane separation unit (hydrogen purifier) 67, stream 27, is mixed with the feed and the combined stream 31 is fed to cryogenic system 33, at 57° F. and 315 psia.

The combined feed stream 31 is cooled to −30° F. in warm heat exchanger 101, to condense most of the $C_3$ and heavier hydrocarbons, stream 151, which are separated from the vapor-liquid stream 103 in separator 105. Most of this liquid, stream 153, is flashed to 60 psia and revaporized in warm exchanger 101. This stream is recovered at 49° F., 57 psia, stream 154. A small portion of the liquid, stream 152, may optionally be removed as a liquid product if not required for refrigeration.

The uncondensed vapor, in line 107, is cooled, partially condensed and rectified in dephlegmator 109 to recover a $C_2$-rich liquid stream 161, and an overhead vapor stream 111. The $C_2$-rich liquid stream 161 is subcooled to −177° F. in dephlegmator 109, flashed to 20 psia, −188° F., and revaporized in dephlegmator 109 for refrigeration. The revaporized $C_2$-rich stream is warmed in warm heat exchanger 101 and recovered at 49° F., 15 psia, stream 165.

The recovered heavy hydrocarbon vapor streams 154 and 165 may be compressed, if necessary and, along with the optional liquid product stream 152, constitute the heavy hydrocarbon products, which may be combined as in stream 51. In this example, the combined heavy hydrocarbon product stream 51 recovers 91% of the ethylene, 99.6% of the ethane, and 100% of the $C_3$ and heavier hydrocarbons in the feed, with a $C_2$+ purity of 88 mole %.

The light overhead vapor stream 111 from dephlegmator 109 is cooled in cold heat exchanger 113 to −261° F., 305 psia, stream 115. The condensed liquids, stream 119, are separated from the hydrogen-enriched gas, stream 121, in hydrogen separator 117. The gas stream 121 has been upgraded from 14 mole % hydrogen in the feed stream 1, to 75 mole % hydrogen, which is now more suitable for feed to a hydrogen purifier. The liquid stream 119 contains most of the methane, $N_2$ and other light components in the feed which are not desired as products.

The condensed liquid stream 119 is flashed to 59 psia, mixed with a small portion of the hydrogen-enriched gas, stream 123, if necessary to facilitate boiling, and vaporized in cold heat exchanger 113. The vaporized stream 141 is warmed in dephlegmator 109 and warm heat exchanger 101 and recovered at 49° F., 52 psia, stream 41, for fuel or other use.

The hydrogen-enriched gas stream 122 is warmed in heat exchangers 113 and 101 and dephlegmator 109 and recovered at 49° F., 295 psia, stream 61. It is fed to hydrogen purifier 67, a membrane separation unit in this example, and recovered as the permeate stream 69, at a purity of 97 mole % hydrogen and a pressure of 100 psia. If necessary, the purified hydrogen is compressed to a higher pressure for further use.

The reject gas stream from the hydrogen purifier, stream 21, at 280 psia, contains 36 mole % hydrogen since the membrane separation unit recovers only 83% of the feed hydrogen as purified product. The reject gas stream 21 is therefore recompressed to feed pressure in recycle compressor 23, cooled if necessary, and mixed with feed gas stream 11 to be recycled through cryogenic system 33. By means of the recycle, the overall hydrogen recovery for the combined process of cryogenic system 33 and hydrogen purifier 67 is increased to 93%.

Using a PSA unit as the hydrogen purifier in this example, the results would be similar, except that the purified hydrogen would be produced at higher pressure, e.g., 290 psia, and the reject gas would be produced at lower pressure, e.g. 20 psia. Hydrogen purity would be higher, 99 mole % or more, but hydrogen recovery in the PSA unit would still be low, e.g. 75%, and recycle is necessary to achieve high overall recovery of hydrogen.

Another alternative is to compress the hydrogen-enriched feed to the hydrogen purifier, stream 61, in booster compressor 63 to overcome the pressure drop in the hydrogen purifier, or to provide additional driving force for the separation in the hydrogen purifier.

This process recovers both high purity hydrogen and one or more heavy hydrocarbon products using cryogenic equipment and upstream equipment such as feed compression, acid-gas removal and drying, which are already necessary for heavy hydrocarbon recovery. Only minor additions are necessary in the cryogenic system to upgrade the low purity hydrogen feed to a purity (i.e. 70 to 90 mole %) which results in an economical final hydrogen purification step, e.g., a membrane or PSA unit. Recycle of reject gas from the hydrogen purifier provides high overall hydrogen recovery, typically 90–95% or more. The hydrogen purifier provides the required high hydrogen purity, i.e., 95–99+ mole %.

Depending on the feed composition, the particular light impurities in the feed gas, the heavy hydrocarbons to be recovered as product, the type of hydrogen purifier to be used, and the required pressures of the various products and fuel, the purity of the enriched hydrogen stream produced from the cryogenic system as feed to the hydrogen purifier can be optimized to minimize the total compression energy requirements. For example, a lower hydrogen purity in the cryogenic system will result in a higher fuel pressure and reduce or eliminate fuel compression, but will increase the amount of recycle compression. Use of a PSA unit for the hydrogen purifier would generally favor producing a higher purity of enriched hydrogen in the cryogenic system to reduce the recycle flow rate, since the PSA recycle gas must be recompressed from a very low pressure compared to the reject gas from a membrane unit.

The combination of a cryogenic system and a hydrogen purifier with recycle to produce both high purity hydrogen and heavy hydrocarbon products provides an economical and energy efficient system to recover high purity hydrogen from feed gases containing very low concentrations of hydrogen. The co-products are made using a large amount of shared equipment, allowing much of the capital costs to be allocated to both products.

Previous processes such as those discussed in the prior art section typically recover only one product. The cost of that product has to include all of the capital costs of the process. This becomes a prohibitive cost for hydrogen in most cases where the concentration of hydrogen in the feed gas is low, and required purity is high.

However, when the cost of heavy hydrocarbon recovery alone is justified, then the added cost of hydrogen recovery is much lower. Only a small incremental increase in refrigeration, and power cost, is required in the cryogenic system to produce an upgraded hydrogen product, i.e. 70–90 mole% hydrogen, as compared to the cost to produce high purity hydrogen, i.e. 95–99+ mole %, via a cryogenic system. Therefore, if the refrigeration power saving (between cryogenic high purity hydrogen and enriched hydrogen products) is greater than the additional recompression/recycle power and capital cost associated with the non-cryogenic hydrogen purifier, then this process will be economical for co-recovery of high purity hydrogen. This was found to be true for both PSA and membrane based processes. The recycle from the hydrogen purifier significantly increases $H_2$ recovery, which further decreases the capital cost per unit of $H_2$ product.

The present invention has been disclosed with reference to a specific embodiment thereof. This embodiment should not be considered a limitation of the present invention, the scope of which should be ascertained by the following claims.

We claim:

1. In a process for the separation and recovery of heavy hydrocarbon and high purity hydrogen products from a feed gas stream containing heavier hydrocarbons and a relatively small concentration of hydrogen, wherein the gas stream is cleaned of acid gases and dehydrated; the cleaned, dehydrated feed gas stream is separated in a cryogenic separation system producing a light fuel gas stream, at least one heavy hydrocarbon product stream, and a hydrogen-enriched gas stream; and the hydrogen-enriched gas stream is purified in a hydrogen purifier thereby producing a high purity hydrogen product stream and a purifier reject stream which is recycled and combined with the cleaned, dehydrated feed gas stream as a combined feed to the cryogenic separation system; the improvement comprising:

(a) cooling and partially condensing the combined feed;

(b) separating the cooled and partially condensed combined feed into a liquid and a vapor phase;

(c) cooling and partially condensing the vapor phase in a dephlegmator wherein in partially condensing the vapor phase, a rectified liquid condensate is recovered from the dephlegmator and warmed to recover refrigeration;

(d) further cooling and partially condensing the non-condensed portion of the vapor phase in indirect heat exchange thereby producing a hydrogen-enriched gas phase and a light fuel liquid phase;

(e) separating the hydrogen-enriched gas phase from the light fuel liquid phase;

(f) warming at least a portion of the liquid phase of step (b) to recover refrigeration;

(g) removing the warmed liquid phase of step (f) and the warmed rectified liquid condensate of step (c) as heavy hdrocarbon product;

(h) flashing and vaporizing the light fuel liquid phase of step (e) to recover refrigeration thereby producing a light fuel gas stream; and (i) warming the hydrogen-enriched gas of step (e) to recover refrigeration and feeding the warmed, hydrogen-enriched gas to the hydrogen purifier.

2. The process of claim 1 which further comprises compressing the hydrogen-enriched gas prior to feeding to the hydrogen purifier.

3. The process of claim 1 which further comprises compressing the heavy hydrocarbon product.

4. The process of claim 1 wherein the hydrogen purifier is a membrane separation unit comprising at least one stage.

5. The process of claim 1 wherein the hydrogen purifier is a pressure swing adsorption unit.

6. The process of claim 1 which further comprises compressing the light fuel gas stream.

7. The process of claim 1 which further comprises compressing the purified hydrogen product from the hydrogen purifier.

8. The process of claim 1 which further comprises compressing the recycle gas stream from the hydrogen purifier.

9. The process of claim 1 wherein the feed gas stream contains less than 40 mole% hydrogen; the high purity hydrogen product stream contains more than 95 mole% hydrogen; and at least 90 vol% of the hydrogen in the feed gas stream is recovered in the high purity hydrogen product stream.

10. The process of claim 1 wherein the heavy hydrocarbon product is fed to a distillation column for further separation and purification.

11. The process of claim 1 wherein the hydrogen-enriched gas is work expanded to provide refrigeration prior to feeding the work expanded, warmed hydrogen-enriched gas to the hydrogen purifier.

* * * * *